US008845408B2

(12) United States Patent
Arnone et al.

(10) Patent No.: US 8,845,408 B2
(45) **Date of Patent: *Sep. 30, 2014**

(54) GAMBLING GAME OBJECTIFICATION AND ABSTRACTION

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/152,953

(22) Filed: Jan. 10, 2014

(65) Prior Publication Data

US 2014/0128152 A1 May 8, 2014

Related U.S. Application Data

(63) Continuation of application No. 14/014,310, filed on Aug. 29, 2013, now Pat. No. 8,636,577, which is a continuation of application No. PCT/US2012/067468, filed on Nov. 30, 2012.

(60) Provisional application No. 61/629,873, filed on Nov. 30, 2011.

(51) Int. Cl.
*G07F 17/32* (2006.01)

(52) U.S. Cl.
USPC ..... 463/16; 463/20; 463/25; 463/42

(58) Field of Classification Search
USPC ..... 463/16, 20, 25, 2, 9
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 A 10/2001
JP 2003111980 A 4/2003

(Continued)

OTHER PUBLICATIONS

ITL.NIST.GOV, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

(Continued)

*Primary Examiner* — Omkar Deodhar
(74) *Attorney, Agent, or Firm* — Frank Cire

(57) ABSTRACT

Systems and methods for configuring a gaming system. In one such gaming system, a plurality of real world engine modules are provided for a hybrid game, each real world engine module having a gambling game that is triggered by an element of an entertainment game of the hybrid game. A selection is received, from a player of the hybrid game, of a selected real world engine module of the plurality of real world engine modules, and triggering is enabled of the selected real world engine module's gambling game by the element of the entertainment game of the hybrid game.

30 Claims, 11 Drawing Sheets

(56) References Cited

U.S. PATENT DOCUMENTS 5,785,592 A 7/1998 Jacobsen
6,050,895 A 4/2000 Luciano
6,227,974 B1 5/2001 Eilat
6,267,669 B1 7/2001 Luciano
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,636,577 B2 * 1/2014 Arnone et al. ..... 463/16
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0234791 A1 10/2006 Nguyen et al.
2006/0258433 A1 11/2006 Finocchio et al.
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0117641 A1 5/2007 Walker et al.
2007/0129149 A1 6/2007 Walker
2007/0156509 A1 7/2007 Jung et al.
2007/0167212 A1 7/2007 Nguyen
2007/0167239 A1 7/2007 O'Rourke
2007/0191104 A1 8/2007 Van Luchene
2007/0203828 A1 8/2007 Jung et al.
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108425 A1 5/2008 Oberberger
2008/0119283 A1 5/2008 Baerlocher
2008/0146308 A1 6/2008 Okada
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0082093 A1 3/2009 Okada
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0176560 A1 7/2009 Herrmann et al.
2009/0176566 A1 7/2009 Kelly
2009/0221355 A1 9/2009 Dunaevsky et al.
2009/0247272 A1 10/2009 Abe
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0035674 A1 2/2010 Slomiany
2010/0056247 A1 3/2010 Nicely
2010/0062836 A1 3/2010 Young
2010/0093420 A1 4/2010 Wright
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304839 A1 12/2010 Johnson
2010/0304842 A1 12/2010 Friedman et al.
2011/0009177 A1 1/2011 Katz
2011/0009178 A1 1/2011 Gergon
2011/0045896 A1 2/2011 Sak et al.
2011/0077087 A1 3/2011 Walker et al.
2011/0082571 A1 4/2011 Murdock et al.
2011/0109454 A1 5/2011 McSheffrey
2011/0111837 A1 5/2011 Gagner

(56) References Cited

U.S. PATENT DOCUMENTS

| | | | |
|---|---|---|---|
| 2011/0118011 | A1 | 5/2011 | Filipour et al. |
| 2011/0201413 | A1 | 8/2011 | Oberger |
| 2011/0207523 | A1 | 8/2011 | Filipour et al. |
| 2011/0212766 | A1 | 9/2011 | Bowers et al. |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0202587 | A1 | 8/2012 | Allen |
| 2012/0322545 | A1 | 12/2012 | Arnone et al. |
| 2013/0131848 | A1 | 5/2013 | Arnone et al. |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2012139083 | A1 | 10/2012 |
| WO | 2013082052 | A1 | 6/2013 |
| WO | 2013082552 | A1 | 6/2013 |

OTHER PUBLICATIONS

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

U.S. Appl. No. 13/854,658, Arnone, et al., filed Apr. 1, 2013.

U.S. Appl. No. 13/855,676, Arnone, et al., filed Apr. 2, 2013.

U.S. Appl. No. 13/872,946, Arnone, et al., filed Apr. 29, 2013.

U.S. Appl. No. 13/886,245, Arnone, et al., filed May 2, 2013.

U.S. Appl. No. 13/888,326, Arnone, et al., filed May 6, 2013.

U.S. Appl. No. 13/890,207, Arnone, et al., filed May 8, 2013.

U.S. Appl. No. 13/896,783, Arnone, et al., filed May 17, 2013.

U.S. Appl. No. 13/898,222, Arnone, et al., filed May 20, 2013.

U.S. Appl. No. 13/900,363, Arnone, et al., filed May 22, 2013.

U.S. Appl. No. 13/903,895, Arnone, et al., filed May 28, 2013.

U.S. Appl. No. 13/917,513, Arnone, et al., filed Jun. 13, 2013.

U.S. Appl. No. 13/917,529, Arnone, et al., filed Jun. 13, 2013.

U.S. Appl. No. 13/920,031, Arnone, et al., filed Jun. 17, 2013.

U.S. Appl. No. 13/928,166, Arnone, et al., filed Jun. 26, 2013.

U.S. Appl. No. 13/935,410, Arnone, et al., filed Jul. 3, 2013.

U.S. Appl. No. 13/935,468, Arnone, et al., filed Jul. 3, 2013.

International Search Report and Written Opinion, PCT/US2012/67468, Mar. 15, 2013.

* cited by examiner

GAMBLING GAME OBJECTIFICATION AND ABSTRACTION

CROSS-REFERENCE TO RELATED APPLICATION

The present application is a continuation U.S. patent application Ser. No. 14/014,310, filed Aug. 29, 2013, which is a continuation of Patent Cooperation Treaty Application No. PCT/US12/67468, filed Nov. 30, 2012, which claims the benefit of U.S. Provisional Patent Application No. 61/629,873, filed Nov. 30, 2011, the contents of each of which are hereby incorporated by reference herein.

FIELD

Embodiments of the present invention are generally related to gaming and more specifically to providing one or more gambling game modules within a hybrid game that includes both an entertainment game and a gambling game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY

Various embodiments of the present invention provide systems and methods for configuring a gaming system. In one embodiment, a plurality of real world engine modules are provided for a hybrid game, each real world engine module having a gambling game that is triggered by an element of an entertainment game of the hybrid game. A selection is received from a player of the hybrid game, of a selected real world engine module of the plurality of real world engine modules, and triggering is enabled of the selected real world engine module's gambling game by the element of the entertainment game of the hybrid game.

In some embodiments, a selection is received, from the player of the hybrid game, of a configuration process for the selected real world engine module; and the real world engine module is configure based on the selected configuration process.

In many embodiments, the selected configuration process is for configuration of the selected real world engine module's gambling game denomination.

In another embodiment, a plurality of real world engine modules are provided for a hybrid game, each real world engine module having a gambling game that is triggered by an element of an entertainment game of the hybrid game, a selection is received from the operator of the hybrid game of a selected real world engine module of the plurality of real world engine modules as well as a selection of a configuration process for the selected real world engine module. The selected real world engine module is configured on the basis of the selected configuration process.

In some embodiments, the selected configuration process is for setting a pay table for the selected real world engine module's gambling game.

In many embodiments, the selected configuration process is for setting a gambling limit for the selected real world engine module's gambling game.

DETAILED DESCRIPTION

Figure 1:
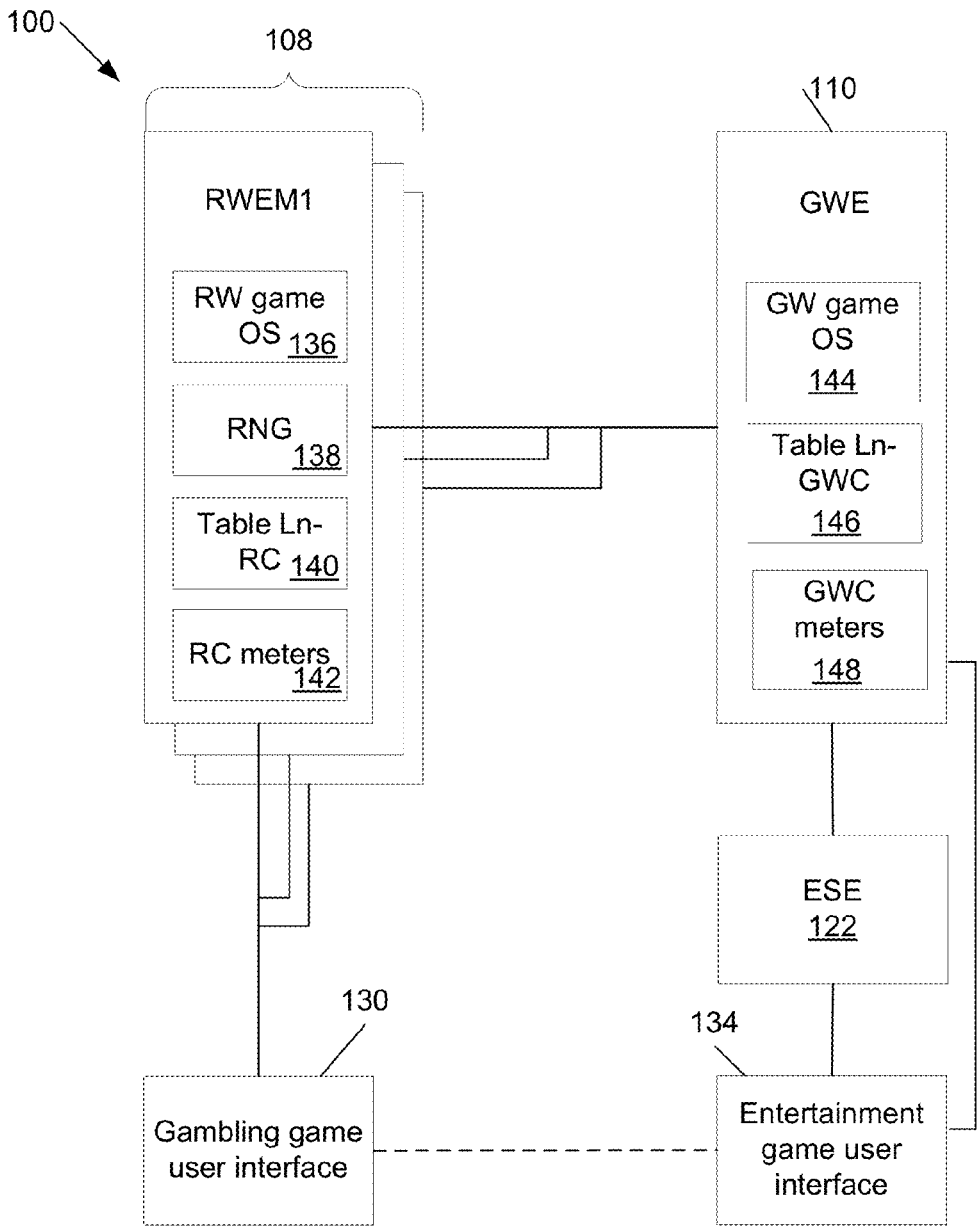
FIG. 1 is an illustration of a gaming environment in accordance with an embodiment.

Turning now to the drawings, systems and methods for operation of a real world engine module hybrid game are illustrated. In several embodiments, a real world engine module hybrid game is a form of a hybrid game that includes one or more real world engine modules (RWEMs) which manage one or more gambling games, as well as an entertainment game that includes a game world engine (GWE) which manages the entertainment portion of a game, and an entertainment software engine (ESE) which executes the entertainment game for user entertainment. In certain embodiments, the real world engine module hybrid game also includes a user interface associated with either or both the one or more gambling games and the entertainment game. In operation of a real world engine module hybrid game, a player acts upon various types of elements of the entertainment game in a game world environment. Upon acting on some of these elements, a wager is triggered in the one or more gambling games. In playing the entertainment game, using the elements, a player can consume and accrue game world credits (GWC) within the entertainment game. These credits can be in the form of (but are not limited to) game world objects, experience points, or points generally. Wagers are made in the one or more gambling games using real world credits (RC). The real world credits can be credits in an actual currency, or may be credits in a virtual currency which may or may not have real world value. Gambling outcomes from the one or more gambling games may cause consumption, loss or accrual of RC. In addition, gambling outcomes in the gambling game may influence elements in the entertainment game such as (but not limited to) by restoring a consumed element, causing the loss of an element, restoration or placement of a fixed element. Example elements include enabling elements (EE) which are elements that enable a player's play of the entertainment game and whose consumption by the player while playing the entertainment game may trigger a wager in the one or more gambling games. In addition, EE may also be replenished during play within the entertainment game based on an outcome of a triggered wager. Other types of elements include actionable elements (AE) which are elements that are acted upon to trigger a wager in the one or more gambling games and may not be restorable during normal play of the entertainment game. Still other elements include collective enabling elements (CEE) which are elements that are shared between two or more players. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety. The operation of various embodiments of RWEs, GWEs and ESEs are also discussed further below.

FIG. 1 is an illustration of an embodiment of a real world engine module hybrid game system. A real world engine module hybrid game 100 is a game that integrates one or more gambling games and an entertainment game. The real world engine module hybrid game includes one or more real world engine modules 108 (RWEM) that manage a gambling portion of the real world engine module hybrid game, a game world engine 110 (GWE) module or element that includes the real world engine module hybrid game control logic portion of the real world engine module hybrid game and manages an interface between the RWE and the entertainment portion of the real world engine module hybrid game, and an entertainment software engine 122 (ESE) module or element that executes the entertainment portion of the real world engine module hybrid game for user entertainment.

The GWE 108 manages ESE game world (GW) and RWEM real world (RW) portions of the real world engine module hybrid game, and includes the mechanical, electronic and software components used to implement the real world engine module hybrid game control logic to perform various functions for the real world engine module hybrid game. For example, various embodiments of a GWE include the functions of: (a) coupling to an ESE to signal and provide controls of the GW portion of the game operating in the ESE, (b) including tables for determining game world credits (GWCs) and, if applicable, take input from this table to affect the play of the GW portion of the game, (c) coupling to an RWE to determine and amount of real credit (RC) available on the real world engine module hybrid game and other metrics of wagering on the RW portion of the game, (d) potentially affect the amount of RC in play, pay tables, odds and other wager shaping factors in operation on the RWE, (e) providing various audit logs and activity meters, and (f) coupling to a centralized server for exchanging various data related to the player and their activities on the game.

The ESE122 is a portion of a real world engine module hybrid game that is an electronic and software system including the control logic that controls the playing of video games for entertainment. The ESE accepts input from a player through a set of hand, foot, body, mind and/or visual controls and outputs video, audio and/or other sensory output to a user interface. A mobile device, such as a smartphone, tablet computer or the like, a personal computer (PC), Sony PlayStation® or Microsoft Xbox® running a specific game program (e.g. a version of Madden Football '10 or Call of Duty®) would be typical examples of hosts for an ESE. For the purposes of this disclosure, the ESE interfaces and exchanges data with and accepts control information from various components in a real world engine module hybrid game, or a system of which the real world engine module hybrid game is a part.

In certain embodiments, the real world engine module hybrid game also includes user interfaces, 130 and 132, associated with either or both the one or more gambling games and the entertainment game, respectively. In many embodiments, an entertainment game is a skill, pseudo-skill or non-skill game, deterministic or interactive, operating on the ESE that provides an entertainment or informative sensory entertainment experience for the player.

In some embodiments, a real world engine module hybrid game is a form of a game, designed for use in a physical or virtual casino environment, that provides players an environment in that to play for cash, prizes and points, either against the casino or in head-to-head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based game. In various environments, an interactive entertainment game is provided where skill and chance may coalesce to provide a rich arcade-style gaming experience, visually exciting and challenging, where players may wager cash, credits prizes and points in order to win more of the foregoing.

The one or more RWEMs 108 function as operating systems for a gambling game of the real world engine module hybrid game 100 and control and operate the gambling game. The operation of a gambling game is enabled by real funds, accretes and declinates real gambling credits based on random gambling outcome, and whose gambling proposition is typically regulated by gaming control bodies. In many embodiments, each of the one or more RWEMs 108 include a real world (RW) operating system (OS) 136, random number generator (RNG) 138, level "n" real-world credit pay tables (table Ln-RC) 140, RC meters 142 and other software constructs that enable a game of chance to offer a fair and transparent gambling proposition, and to include the auditable systems and functions that can enable the game to obtain gaming regulatory body approval.

Real-world credit pay tables are tables and/or algorithms that may exist, and may be used in conjunction with a random number generator to dictate the RC earned as a function of a wager proposition and is analogous to the pay tables used in a conventional slot machine. There may be one or a plurality of table Ln-Rc pay tables included in a game design.

In some embodiments, the RWEM is a portion of a real world engine module hybrid game which operates the RC wagering aspects, and includes the mechanical, electronic and software aspects to perform the following non-exhaustive list of functions: (a) include or interface to an RNG and provide control of the RW portion of the game, (b) include table Ln-RC and to take input from this table to affect the wagering activity of the game, (c) couple to the GWE to communicate the amount of RC available on the game, (d) communicate other metrics of wagering and its status to the GWE, (e) accept input from the GWE as to the amount of RC to be wagered, (f) accept signaling from the GWE in order to trigger execution of an wagering play, (g) include various audit logs and activity meters, (h) couple to a centralized server for exchanging various data related to accounting of the wagering proposition, the player and their wagering activities on the game. Certain aspects of an RWE would be analogous to components within a slot machine.

A real world can be considered a physical world of which humans are a part, as opposed to the virtual game world. As contemplated in various embodiments, this may also be used in the context of the gambling or wagering portion of the game hybrid game (the one or more RW EMs) which may or may not include an entertainment portion of their own, but whose fundamental operation is enabled by real funds, and which accrete and declinate real wagering credits and/or funds based on random wagering outcomes, and whose wagering propositions are typically regulated by gaming control bodies.

A random number generator (RNG) 138 includes software and/or hardware algorithms and/or processes that are used to generate random or pseudorandom outcomes. A level n real-world credit pay table (table Ln-RC) 140 is a table that can be used in conjunction with a random number generator to dictate the real world credits (RC) earned as a function of game play and is analogous to the pay tables used in a conventional slot machine. Table Ln-Rc payouts are independent of player skill. There may be one or a plurality of table Ln-Rc pay tables contained in a gambling game, the selection of which may be determined by game progress a player has earned, and bonus rounds, which a player may be eligible for. Real world credits (RC) are credits analogous to slot machine game credits, which are entered into a gambling game by the user, either in the form of hard currency or electronic funds. RCs can be decremented or augmented based on the outcome of a random number generator according to the table Ln-Rc real world credits pay table, independent of player skill. In certain embodiments, an amount of RC can be required to enter higher ESE game levels. RC can be carried forward to higher game levels or paid out if a game cash out is opted for by a player. The amount of RC required to enter a specific level of the game "level n" need not be the same for each level.

In many embodiments, the GWE 110 manages the overall hybrid game operation, with the one or more RWEMs 108 and the ESE 122 effectively being support units to the GWE 110. In several embodiments, the GWE 110 contains mechanical, electronic and software system for an entertainment game. The GWE includes a game world (GW) game operating system (OS) 144 that provides control of the entertainment game.

In some embodiments, the GWE also manages game world credits (GWCs) that are player and/or game GW points earned or depleted as a function of a player's skill or player performance in the context of an entertainment (i.e. ESE) game. GWC is analogous to the "score" in a typical video game. Any given entertainment game may have a scoring criterion native to its makeup, and methods for utilizing this score in the context of the real world engine module hybrid game may be embedded within a table Ln-GWC that reflects player performance against the goal(s) of the entertainment game. In some embodiments, GWC may be fungible between hybrid games, and may be carried forward from one level of game play to another in any given entertainment game. There may be one or more types of GWC present in a real world engine module hybrid game. GWC may be ultimately paid out in various manners such as directly in cash and goods prizes, or indirectly such as consumed or benchmarked for earning entrance into a sweepstakes drawing, or earning participation in a tournament with prizes, or indirectly by purchases and redemptions within the GW entertainment game context. In many embodiments, GWC may be utilized to determine ranking of players, and winners in tournaments. In some embodiments, GWC may be attributed to a specific player or player's avatar in the GW, may be stored on a system under a player account for accumulation over time and retrieval, and/or may be stored on a card or other transportable media.

In many embodiments, the GWE additionally contains a level "n" game world credit pay table (table Ln-GWC) 146 indicating where to take input from this table to affect the play of the entertainment game. The GWE can further couple to the one or more RWEMs 108 to determine the amount of RC available on the game and other metrics of wagering on the gambling game (and potentially affect the amount of RC in play on the one or more RWEMs 108). The GWE additionally contains various audit logs and activity meters (such as the GWC meter 148). The GWE can also couple to a centralized server for exchanging various data related to the player and their activities on the game. The GWE furthermore couples to the ESE 122.

In many embodiments, a level "n" game world credit pay table (table Ln-GWC) 146 dictates the GWC earned as a function of player skill in the nth level of the game. The payouts governed by this table are dependent upon player skill and game play at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each game has one or more scoring criterion, embedded within the table Ln-GWC 146 that reflects player performance against the goal(s) of the game. GWC can be carried forward from one level of game play to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In some embodiments, the operation of the GWE 110 does not affect the one or more RWEM's 108 gambling operation except for player choice parameters that are allowable in slot machines today, such as the wager amount, how fast the player wants to play, agreement to wager into a bonus round, etc. In this sense, the one or more RWEMs provide a fair and transparent, non-skill based gambling proposition co-processor to the GWE. In the illustrated embodiment, the communication links shown between the GWE 110 and the one or more RWEMs 108 allow the GWE 110 to obtain information from the one or more RWEMs 108 as to the amount of RC available in the gambling game. The communication link can also convey a necessary status operation of the one or more RWEMs 108 (such as on-line or tilt). The communication link can further communicate the various gambling control factors, which the one or more RWEMs 108 use as input, such as the number of RC consumed per game or the player's election to enter a jackpot round.

In some embodiments, the GWE 110 also connects to the player's user interface 134 directly, as this may be necessary to communicate certain entertainment game club points, player status, control the selection of choices and messages which a player may find useful in order to adjust their entertainment game experience or understand their gambling status in the one or more RWEMs 108.

In various embodiments, the ESE 122 manages and controls the visual, audio, and player controls for the entertainment game. In certain embodiments, the ESE 122 accepts input from a player through a set of hand controls, and/or head, gesture, and/or eye tracking systems and outputs video, audio and/or other sensory output to a user interface. In many embodiments, the ESE 122 can exchange data with and accept control information from the GWE 110. In several embodiments an ESE 122 can be implemented using a personal computer (PC), a mobile device such as a smartphone, a tablet computer, a personal digital assistant, a Sony PlayStation® (a video game console developed by Sony Computer Entertainment of Tokyo Japan), or Microsoft Xbox® (a video game console developed by Microsoft Corporation of Redmond, Wash.) running a specific game program.

The ESE 122 operates mostly independently from the GWE 110, except that via their interface, the GWE 110 may send certain GW game control parameters to the ESE 122 to affect the entertainment game's play, such as (but not limited to) what level of character to be used, changing the difficulty level of the game, changing the type of game object, such as a gun or a car, in use, requesting potions to become available or to be found by the character, etc. The ESE 122 can accept this input from the GWE 110, make adjustments, and continue the play action all the while running seamlessly from the player's perspective. The ESE's 122 operation is mostly skill based, except for where the ESE's algorithm may inject complexities into the game by chance in its normal operation to create unpredictability in the entertainment game. Utilizing this interface, the ESE may also communicate player choices made in the game to the GWE 110, such as selection of a different gun, the player picking up a special potion in the GW environment, etc.

In other embodiments, operation of an entertainment game of a real world engine module hybrid game by a player consumes one or more enabling elements (EEs) within the entertainment game. An EE is an element in the entertainment game that is consumed by, traded or exchanged in, operated upon, or used to enable the entertainment game portion of the real world engine module hybrid game. There may be one or more types of EE present in the real world engine module hybrid game's entertainment game. Examples of EE include bullets in a shooting game, fuel in a racing game, letters in a word spelling game, downs in a football game, potions in a character adventure game, character health points, etc. The GWE can associate consumption of an EE with the triggering of a commitment or wager of RC to a gambling game of the real world engine module hybrid game whereby commitment or wagering of the RC in the gambling game is coordinated with the consumption of the EE in the entertainment game because of actions of the player. Furthermore, the GWE can provide an increment or decrement of EE available to the player in coordination with the gambling outcome of the gambling game such as by incrementing the EE when RC is won or decrementing EE when RC is lost.

The GWE's job in this architecture, being interfaced thusly to the ESE, is to allow the coupling of entertainment software to a fair and transparent random chance gambling game, providing a seamless perspective to the player that they are playing a typical popular entertainment game (which is skill based). In certain embodiments, the ESE 122 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.), etc.). Providers of such software can provide the previously described interface by which the GWE 110 can request amendments to the operation of the ESE software in order to provide the seamless and sensible operation of the real world engine module hybrid game as both a gambling game and an entertainment game.

In several embodiments, the one or more RWEMs 108 can accept a trigger to run a gambling game in response to actions taken by the player in the entertainment game as conveyed by the ESE 122 to the GWE 110, or as triggered by the GWE 110 based on the GWE's control logic, in the background to the overall game from the player's perspective, and can provide information to the GWE 110 to expose the player to certain aspects of the gambling game, such as (but not limited to) odds, amount of RC in play, and amount of RC available. The one or more RWEMs 108 can accept modifications in the amount of RC wagered on each individual gambling try, or the number of games per minute the one or more RWEMs 108 can execute, entrance into a bonus round, and other factors, all the while these factors can take a different form than that of a typical slot machine. An example of a varying wager amount that the player can choose might be that they have decided to play with a more powerful character in the game, or having a more powerful gun, a better car, etc. These choices can increase or decrease the amount wagered per individual gambling game, in the same manner that a standard slot machine player may decide to wager more or less credits for each pull of the handle. In several embodiments, the one or more RWEMs 108 can communicate a number of factors back and forth to the GWE 110, via their interface, such as an increase or decrease in a wager being a function of the player's decision making as to their operational profile in the entertainment game (i.e. power of the character, gun selection, car choice, etc.). In this manner, the player is always in control of the per game wager amount, with the choice mapping to some parameter or component which is applicable to the entertainment game experience of the real world engine module hybrid game. In a particular embodiment, the RWE operation can be a game of chance running every 10 seconds where the amount wagered is communicated from the GWE 110 as a function of choices the player makes in the operation profile in the entertainment game such as those cited above.

In many embodiments, a real world engine module hybrid game integrates a video game style gambling machine, where the gambling game (i.e. the one or more RWEMs 108 and RC) is not player skill based, while at the same time allows players to use their skills to earn GWC or club points which a casino operator can translate to rewards, tournaments opportunities and prizes for the players. The actual exchange of monetary funds earned or lost directly from gambling against a game of chance, such as a slot machine, is preserved. At the same time, a rich environment of rewards to stimulate "garners" can be established with the entertainment game. In several embodiments, the real world engine module hybrid game can leverage very popular titles with "garners" and provides a sea change environment for casinos to attract players with games that are more akin to the type of entertainment, which a younger generation desires. In various embodiments, players can use their skill towards building and banking GWC, which in turn can be used to win tournaments and various prizes as a function of their "garners" prowess. Numerous embodiments minimize the underlying changes needed to the aforementioned entertainment software (Gears of War, etc.), for the real world engine module hybrid game to operate within an entertainment game construct, thus making a plethora of complex game titles and environments, rapid and inexpensive to deploy in a gaming environment.

In various embodiments, a system is provided that effects the integration of modules or elements allowing players to utilize a new type of slot machine game that operates on and/or accrues or consumes new forms of currency, one such currency being legal tender or script as real world credit (RC), another currency being game world credit (GWC), as the system integrates a traditional game of random chance playing for RC that functions in concert with a skill game playing for GWC.

In various embodiments, a real world engine module hybrid game can be played by users on a wide area network, such as the Internet, through a website (e.g. Facebook®, addictinggames.com, bodog.com, etc.) or a dedicated application running on a computer such as an iPad, mobile phone, laptop, PlayStation®, or other computer device. In some embodiments, a flexible gaming environment organizes the various modules or elements into a system that can enable game play with a gambling component, allowing various combinations of the modules or elements (from one or more distinct entities) to be organized to achieve a specific player experience, while providing for regulation, oversight and auditing of a gaming businesses.

In some embodiments, to bring into effect an instance of a real world engine module hybrid game on-line, a number of modules or elements are present. These include an entertainment software engine (ESE), that provides rich multi-media output of high entertainment value to the player, a game world engine (GWE), and a real world engine or (RWE).

In various embodiments, all of these modules or elements of a real world engine module hybrid game can be present in a single physical game located on the floor of a casino. In other embodiments, each of these modules or elements (or a subset of them) can be distributed across servers that are not physically coincident. In some of these embodiments, these modules or elements can be dynamically organized, or put another way, mixed, to alter the implementation of the real world engine module hybrid game in response to the desires of the player or the company or companies that control various embodiments of the value chain related to providing end users with a complete gaming experience while providing that regulatory and auditing requirements are met.

In some embodiments, the ESE, GWE and the one or more RWEMs can be resident on one or more computers and tied together (i.e. the software in each instance of the aforementioned modules or elements is programmed to connect to a specifically named module or element of each other) to provide the functionality necessary to implement the real world engine module hybrid game. In this embodiment, regulating and auditing of the system is achieved through the functionality of the various modules or elements making up the real world engine module hybrid game, and it is likely, though not necessary, that each of these functional modules or elements are under the control of a single entity that is effectively delivering the entire game experience to the end user. A real world (RW) and game world (GW) user interfaces could, for example, share a single window in a web-browser, or operate through separate windows in a web browser. In some embodiments, a game world includes an entertainment portion of a real world engine module hybrid game and is made up of information typically associated with a virtual entertainment environment, including the real world engine module hybrid game's visual and logical game space, game state, game characters, progress points and scores. For the purposes of this disclosure, typical games played on a gaming console, such as a Sony PlayStation®, or a PC could be thought of as in the GW.

In some embodiments, the games could also take the form of more freestanding web-enabled apps resident on a mobile device or other computer.

In other embodiments, the various functional modules or elements are not tied together inextricably but rather can be organized dynamically in response to commands from a control layer, thereby allowing a specific combination of ESE, GWE, one or more RWEMs (and also potentially a game world credit exchange (GWCE)) to be organized dynamically in response to input provided from one or more parties (e.g. the player, the operator of the site through that the player interfaces to the game, a provider of gambling services, regulatory bodies, etc.). In some embodiments, this dynamic organization can be undertaken as often as every game session that is commenced by a player, or much less frequently (i.e. a web site operator, provider of gambling services, regulatory body, and/or other parties may establish a more "permanent" arrangement that persists across a fixed period of time).

Figure 2:
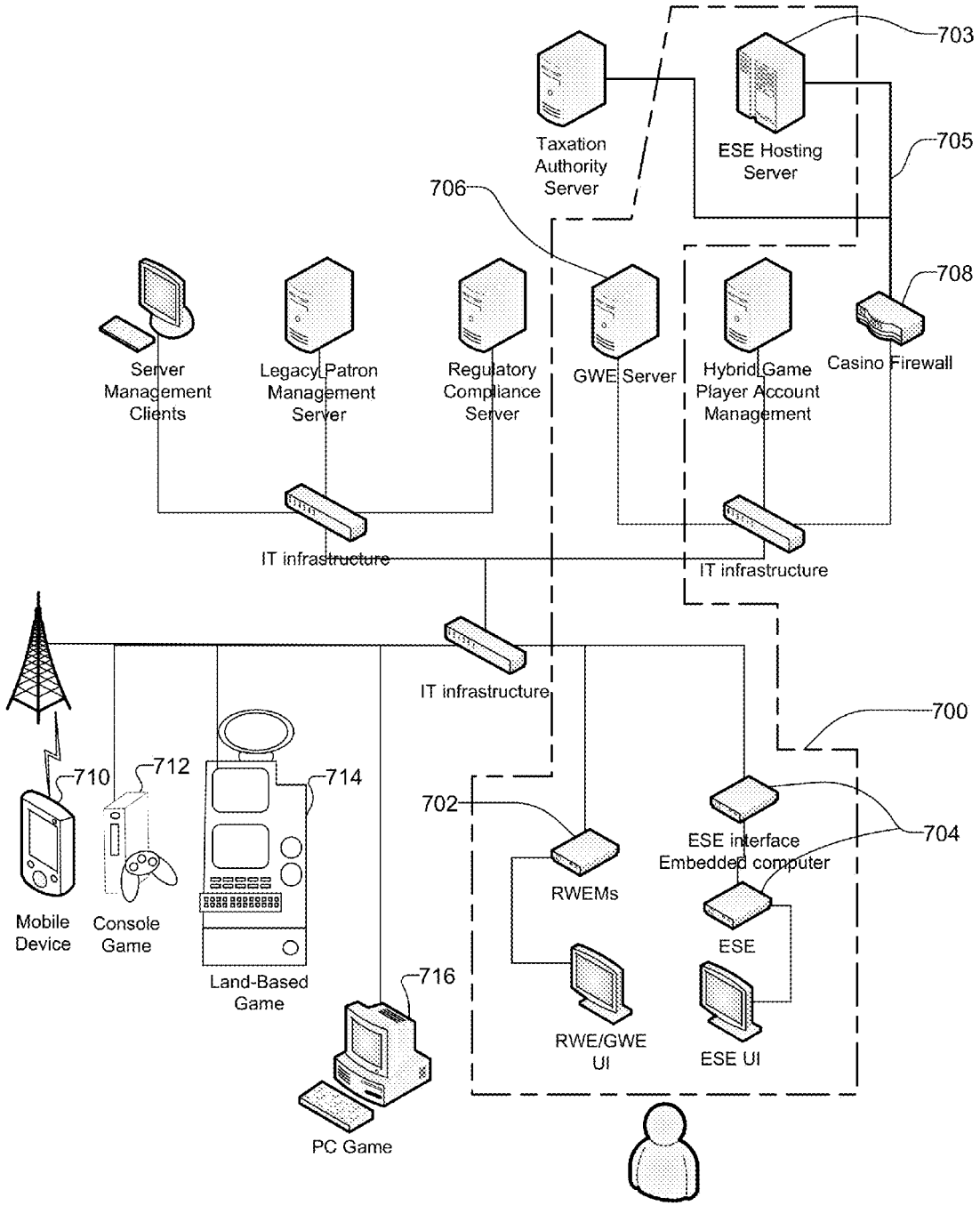
FIG. 2 is a diagram showing an implementation of a real world engine module hybrid game in a casino in accordance with an embodiment.

FIG. 2 is a diagram showing an implementation of a real world engine module hybrid game in a casino in accordance with an embodiment. In the figure, the real world engine module hybrid game 700 components, RWEMs 702, ESE 704 and GWE 706 are bordered by the dashed line. Also pictured in the diagram are a number of other peripheral systems, such as player management, casino management, regulatory, and hosting servers that may be present in such an implementation. FIG. 2 also illustrates various other systems, which may reside outside the bounds of the casino and are connected to the framework via communications network, such as the Internet 705, depicted by the connection lines past the casino firewall 708. It should be understood that FIG. 2 does not attempt to illustrate all servers and systems to which a real world engine module hybrid game 700 might be inevitably be connected, and indeed one might expect there would be others, but rather provides an example of a set of a sub-set of systems which would be present in an installation. In addition, real world engine module hybrid games may be implemented using a variety of different kinds of hosts, such as, but not limited to, a mobile computing device, tablet computer or smartphone 710, a gaming console 712, a land-based casino game 714 and a personal computer 716.

Figure 3:
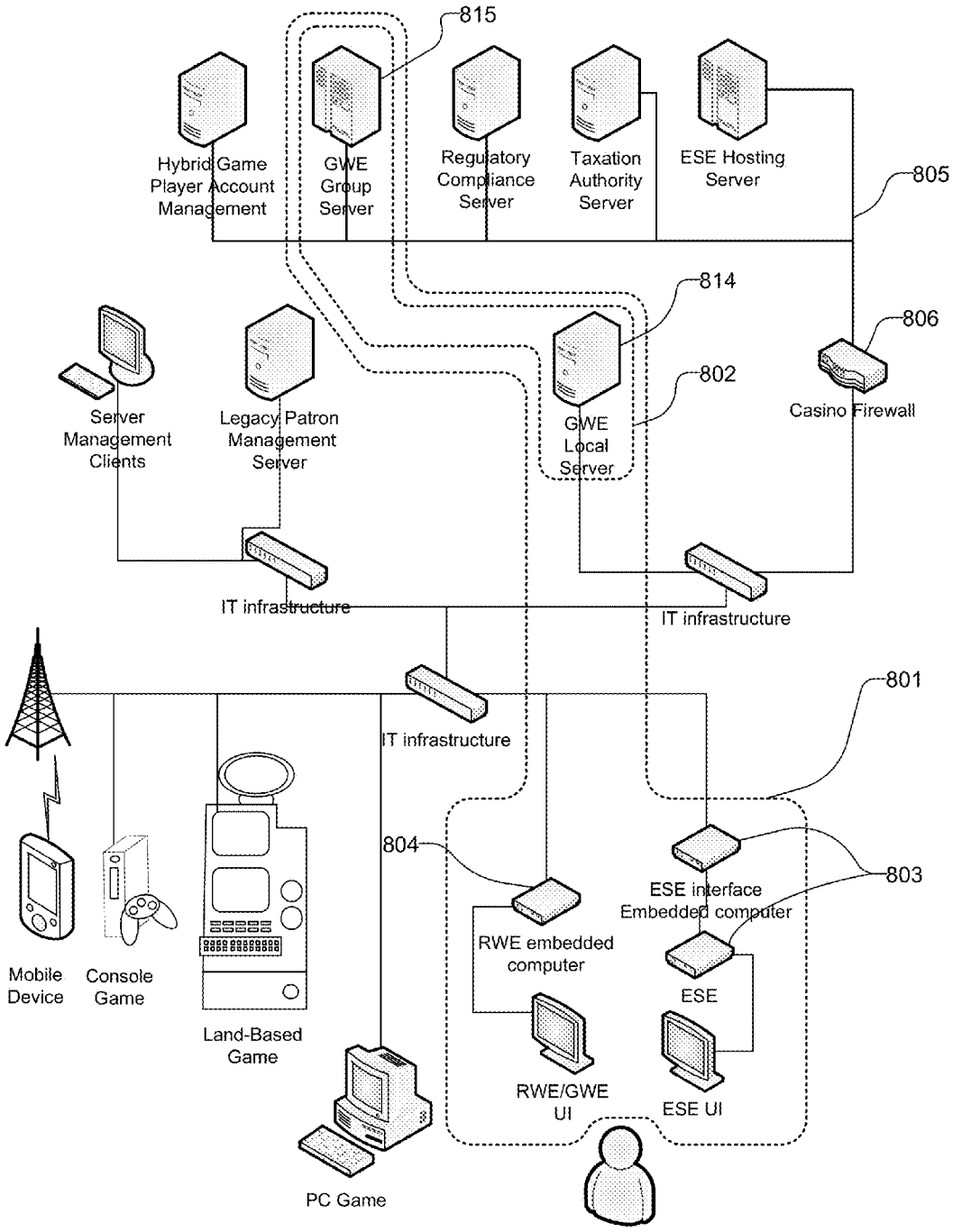
FIG. 3 is a diagram showing another implementation of a real world engine module hybrid game in accordance with an embodiment.

FIG. 3 is a diagram showing another implementation of a real world engine module hybrid game in accordance with an embodiment. Pictured are various components that under one implementation are the GWE 802, the ESE 803 and the one or more RWEMs 804. In the figure, note that the GWE is comprised of two sub-components, a local GWE server 814, and a cloud server 815. (components within the dash line area 801). In the figure, certain of the components are located within the bounds of a casino, namely the RWEMs 804, the ESE 803 and a portion of the GWE 802, namely the local GWE server 814. The Cloud Server GWE 815 is located in the cloud connected to the casino bounded hybrid game components via communications network such as the Internet 805.

Figure 4:
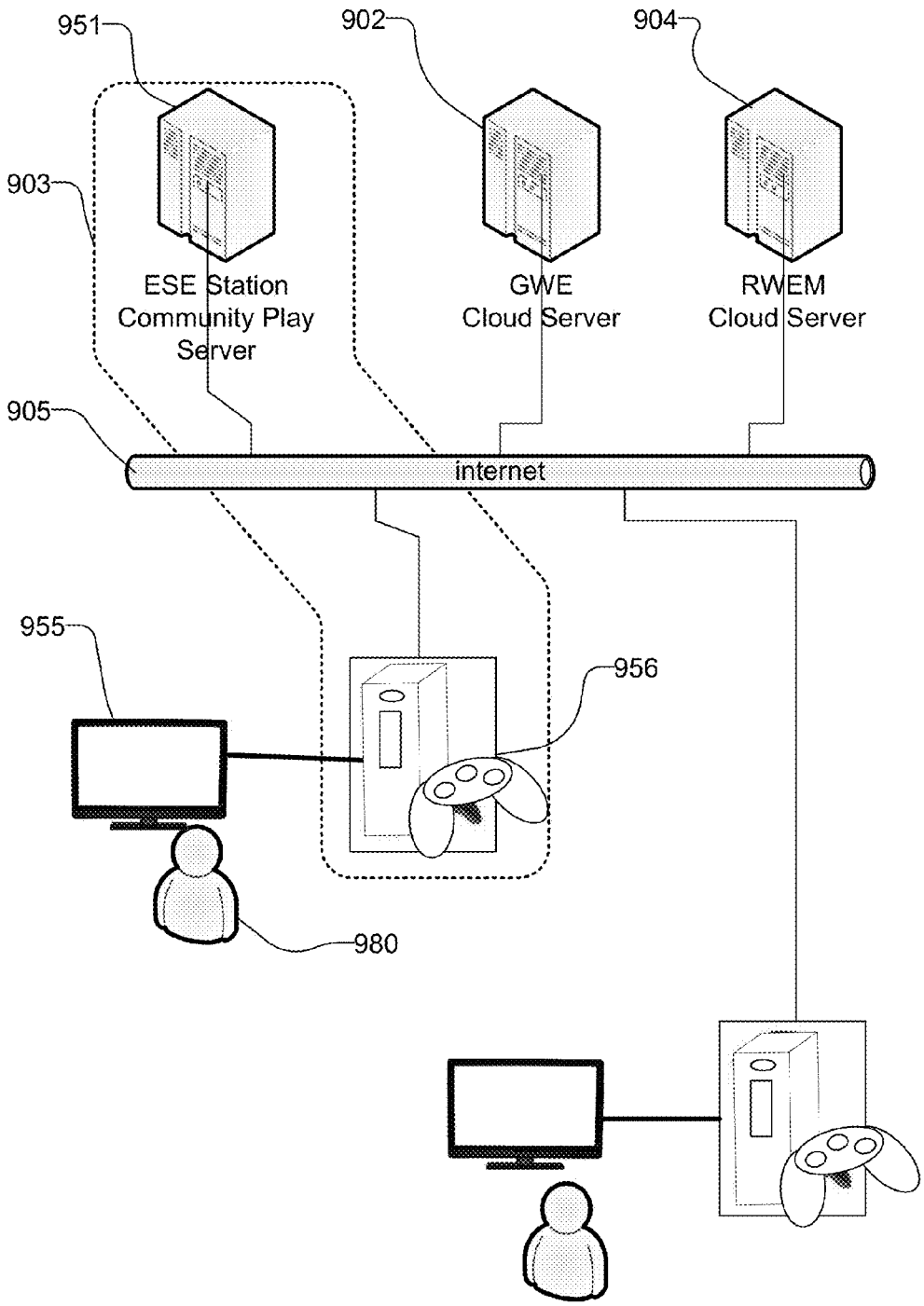
FIG. 4 is a diagram of another implementation of a real world engine module hybrid game in accordance with an embodiment.

FIG. 4 is a diagram of another of a real world engine module hybrid game in accordance with another embodiment. In the diagram, a real world engine module hybrid game 903 is composed of various components connected together by a communications network, such as the Internet 905. In this particular aspect, the ESE 903 is made up of sub components consisting of a typical home video game console 956 (or other types of home gaming computer) coupled to an ESE hosting server 951 which in this example provides for community and head to head play among multiple players on connected consoles 956, reflected in the diagram by the pictured second player and video game console. Also shown, is a UI 955 coupled to the video game console 956 to provide for a player 980 interface. The other modules or elements of a real world engine module hybrid game are also pictured, namely the GWE 902 in the form of a cloud server, and the one or more RWEMs 904 that are hosted by a cloud server. It should be noted that the FIG. 4 implementation is the real world engine module hybrid game architecture accomplished primarily in the cloud, functionally equivalent to the land based and semi-land based solutions shown in FIGS. 2 and 3.

There are many possible permutations of how a real world engine module hybrid game could be constructed, with FIGS. 2, 3 and 4 showing only three possible permutations and provided as examples, which are not intended to suggest limitations to the forms of the architecture. Other embodiments include a version where the entire hybrid game is in the cloud with only a client running on player terminal within the bounds of the casino, or a version where the one or more RWEMs and GWE are casino bound and the ESE exists in the cloud, accessed by a client running on a terminal in the casino.

Figure 5:
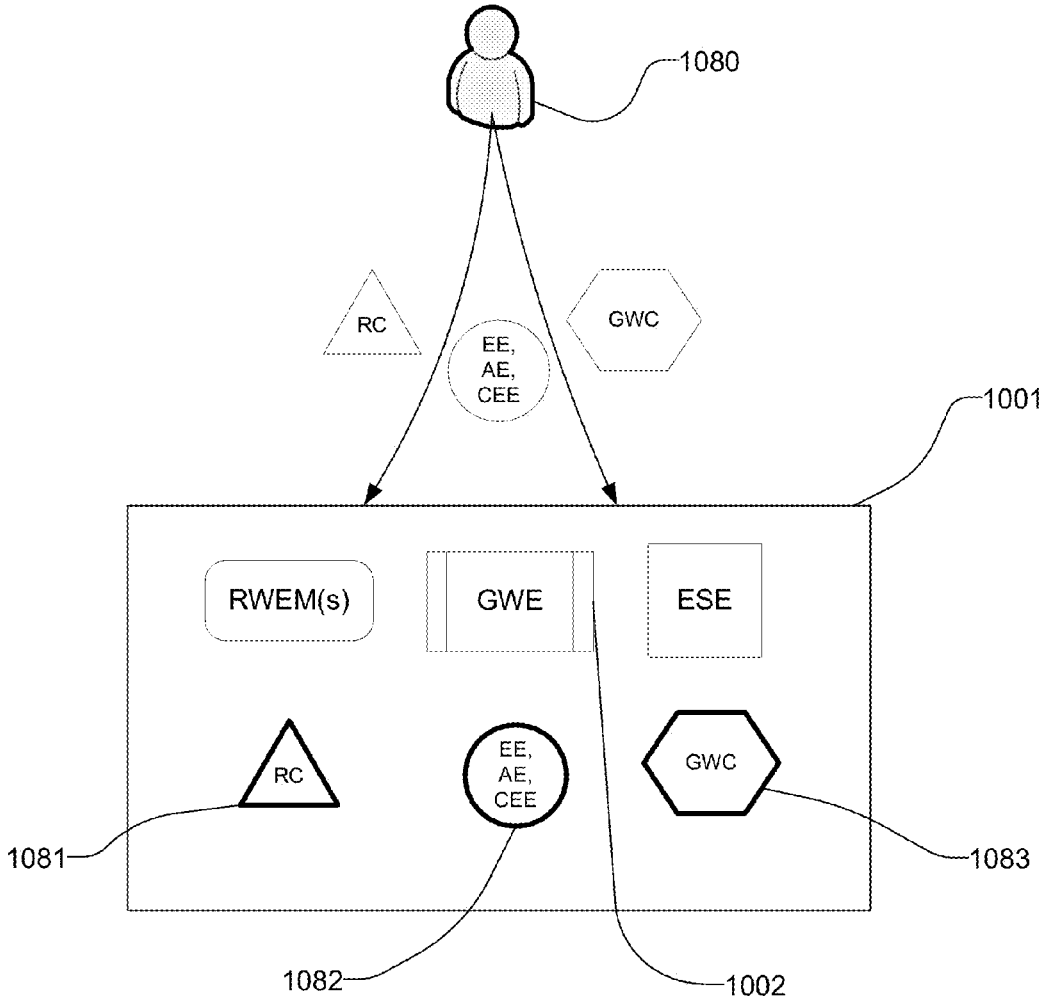
FIG. 5 illustrates an overview of a credit system of a real world engine module hybrid game in accordance with an embodiment.

FIG. 5 illustrates an overview of a credit system of a real world engine module hybrid game in accordance with an embodiment. In the figure, the player 1080 commences interaction with the game by contributing one or more of three types of credits to the game, the three being: (i) RC 1081 which is a currency fungible instrument, (ii) GWC 1083 which are game world credits, and (iii) EE, AE or CEE 1082 which are classes of enabling elements of the entertainment portion of the game running on the ESE. An enabling element is an element of an entertainment game that is consumed by, traded or exchanged in, operated upon, or used to enable the entertainment game portion of the real world engine module hybrid game. There may be one or more types of EE present in a real world engine module hybrid game's entertainment game. Examples of EE include bullets in a shooting game, fuel in a racing game, letters in a word spelling game, downs in a football game, potions in a character adventure game, character health points, etc.

The contribution of one or more of these elements may be executed by insertion into the game of currency in the case of RC, and/or transferred in as electronic credit in the case of any of the RC, GWC and elements. Electronic transfer in of these credits may come via a smart card, voucher or other portable media, or as transferred in over a network from a patron server or hybrid game player account server. In certain implementations, these credits may not be transferred into the real world engine module hybrid game, but rather drawn on demand from player accounts located in servers residing on the network or in the cloud on a real time basis as the credits are consumed by the real world engine module hybrid game. Once these credits are deposited, or a link to their availability is made, the real world engine module hybrid game has them at its disposal to use for execution of the game. Generally, the RC is utilized by and accounted for by the RWE 1004, and the EE 1082 and GWC 1083 are utilized and accounted for by the GWE and/or the ESE.

Figure 6:
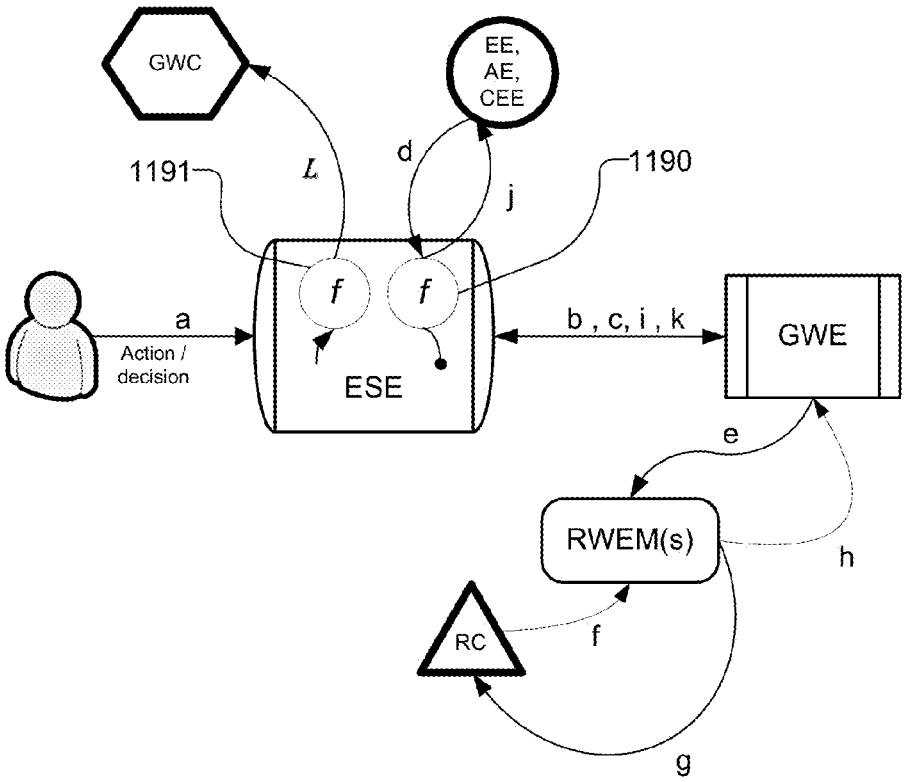
FIG. 6 shows a credit flow and management in a real world engine module hybrid game in accordance with an embodiment.

FIG. 6 shows a credit flow and management in a real world engine module hybrid game in accordance with an embodiment. Pictured in the figure are hybrid game modules or elements RWE, GWE and ESE, and the three types of credits, RC, classes of enabling elements and GWC as previously described. In FIG. 6, the following steps occur in credit flow and management:

TABLE 1

| Hybrid Game Credit Flow and Management |
|---|
| a the player performs an action or makes a decision through the game UI |
| b the ESE signals the GWE of the player decision or action taken |

TABLE 1-continued

| Hybrid Game Credit Flow and Management |
|---|
| c the GWE signals the ESE as to the amount of enabling elements that will be consumed by the player action or decision. This signaling configures function 990 to control the enabling element consumption, decay or addition |
| d the ESE consumes the amount of enabling element designated by the GWE to couple to the player action |
| e the GWE signals the RWEM(s) as to the profile of the wager proposition associated with the particular action, and triggers the wager |
| f the RWEM(s) consumes RC for the wager and executes the wager |
| g the RWEM(s) returns RC depending on the outcome of the wager |
| h the RWEM(s) informs the GWE as to the outcome of the wager |
| i The GWE signals the ESE to add additional (or subtract, or add 0) enabling element to one or more of the enabling elements of the ESE entertainment game. This is reflected as function 990 in the FIGURE. |
| j The ESE reconciles the enabling element (s) of the entertainment game. |
| k The ESE signals the GWE as to its updated status, and the GWE signals the ESE to add additional (or subtract, or add 0) GWC to one or more of the GWC of the ESE entertainment game. This is reflected in function 991 in the FIGURE. |
| L The ESE reconciles the GWC(s) of the entertainment game. |

The credit flow according to the method described above, can be illustrated by the following example in a first person shooter game, such as Call of Duty®, again using the same hybrid game sequence:

TABLE 2

| Example Hybrid Game Credit Flow and Management |
|---|
| a the player selects a machine gun to use in the game. The player fires a burst at an opponent. {the player performs an action or makes a decision through the game UI} |
| b the ESE signals the GWE of the player's choice of weapon, that a burst of fire was fired, and the outcome of whether the player hit the opponent with the burst of fire. {the ESE signals the GWE of the player decision or action taken} |
| c the GWE processes the information in b above, and signals the ESE to consume 3 bullets (EE) with each pull of the trigger. {the GWE signals the ESE as to the amount of enabling element that will be consumed by the player action or decision. This signaling configures function 990 to control the EE consumption, decay or addition} |
| d the ESE entertainment game consumes 3 bullets (EE) since the trigger was pulled. {the ESE consumes the amount of enabling element designated by the GWE to couple to the player action} |
| e the GWE signals the RWE that 3 credits (RC) are to be wagered to match the 3 bullets (EE) consumed, on a particular pay table (table Ln-RC) as a function how much damage the player inflicted on his/her opponent. {the GWE signals the RWE as to the profile of the wager proposition associated with the particular action, and triggers the wager} |
| f the RWEM(s) consumes the 3 credits for the wager and executes the specified wager {the RWEM(s) consumes RC for the wager and executes the wager} |
| g the RWEM(s) determines that the player hits a jackpot of 6 credits, and returns these 6 credits (RC) to the credit meter. {the RWEM(s) returns RC depending on the outcome of the wager} |
| h the RWEM(s) informs the GWE that 3 credits (RC) net, were won {the RWEM(s) informs the GWE as to the outcome of the wager} |
| i the GWE signals the ESE to add 3 bullets (EE) to the player's ammo clip {The GWE signals the ESE to add additional (or subtract, or add 0) enabling elements to one or more of the enabling elements of the ESE entertainment game. This is reflected as function 990 in the FIGURE} |
| j the ESE adds back 3 bullets (EE) to the player's ammo clip in the entertainment game. This may take place by directly adding them to the clip, or may happen in the context of the entertainment game, such as the player finding extra ammo on the ground or in an old abandoned ammo dump. |

TABLE 2-continued

| Example Hybrid Game Credit Flow and Management | |
|---|---|
| | {The ESE reconciles the enabling element(s) of the entertainment game} |
| k | The GWE logs the new player score (GWC) in the game (as a function of the successful hit on the opponent) based on ESE signaling, and signals the ESE to add 2 extra points to their score since a jackpot was won. {The ESE signals the GWE as to its updated status, and the GWE signals the ESE to add additional (or subtract, or add 0) GWC to one or more of the GWC of the ESE entertainment game. This is reflected in function 991 in the FIGURE} |
| L | the ESE adds 10 points to the player's score (GWC) given the success of the hit which in this example is worth 8 points, plus the 2 extra points requested by GWE. {The ESE reconciles the GWC(s) of the entertainment game.} |

Note that the foregoing example in Table 2 is intended to provide an illustration of how credits flow in a real world engine module hybrid game, but is not intended to be exhaustive and only lists only one of numerous possibilities of how a real world engine module hybrid game may be configured to manage its fundamental credits.

Although various components of real world engine module hybrid games are discussed above, real world engine module hybrid games can be configured with any component appropriate to the requirements of a specific application in accordance with various embodiments.

Real World Engine Modules

In several embodiments, one or more RWEMs are embedded within a real world engine module hybrid game. They are attached to any event, item, action, occurrence, or initiating event within an entertainment game of the. The real world engine module hybrid game uses a defined set of function culls to attach a gambling process to specific aspects of the underlying video game. The video game system is thus configured to look in a specific location to find RWEMs. If the RWEMs are absent, they are not used and the video game operates absent the RWEM or RWEM's that are not at the specified address(es). In some embodiments, the locations of the RWEMs correspond to addresses on a network, such as IP addresses, where RWEMs may be found. In many embodiments, the locations correspond to internal memory locations where RWEMs may be found.

In many embodiments, each RWEM constitutes a singular gambling game.

In some embodiments, a real world engine module hybrid game can access RWEMs from multiple providers.

In numerous embodiments, a real world engine module hybrid game includes an RWEM display function to display information about a player's gambling status. Such a display function may acquire information from an RWEM or a patron management system connected to the RWEM.

In many embodiments, a real world engine module hybrid game also interfaces with a patron management system which contains all player account information regarding gambling plays, and if desired, results of entertainment game performance.

In various embodiments, an RWEM can drive any combination of skill or gambling-related outcomes. In one embodiment, a gambling game of the RWEM can always return $1 when initiated, making the payout a skill-based payout. In another embodiment, an RWEM deducts $1 every time a gambling game is initiated, making the initiation of the gambling game an entry fee, or a penalty, for example.

In numerous embodiments, an RWEM display function can be singular within a game, such as a "gambling dashboard". In other embodiments, an RWEM display function is specific to a particular RWEM, such that there are multiple instances of the display functions if there are multiple RWEMs in a real world engine module hybrid game.

In some embodiments, the real world engine module hybrid game also has a host mode where a player learns about gambling options in the context of the entertainment game and can opt to turn on/off some or all RWEMs, set gambling limits, etc. In one embodiment, the host mode is embedded in the entertainment game system. In another embodiment, the host mode is accessed through the entertainment game but, like the RWEM's, may be external to the video game and accessed through the entertainment game or the RWEM display function.

Figure 7A:
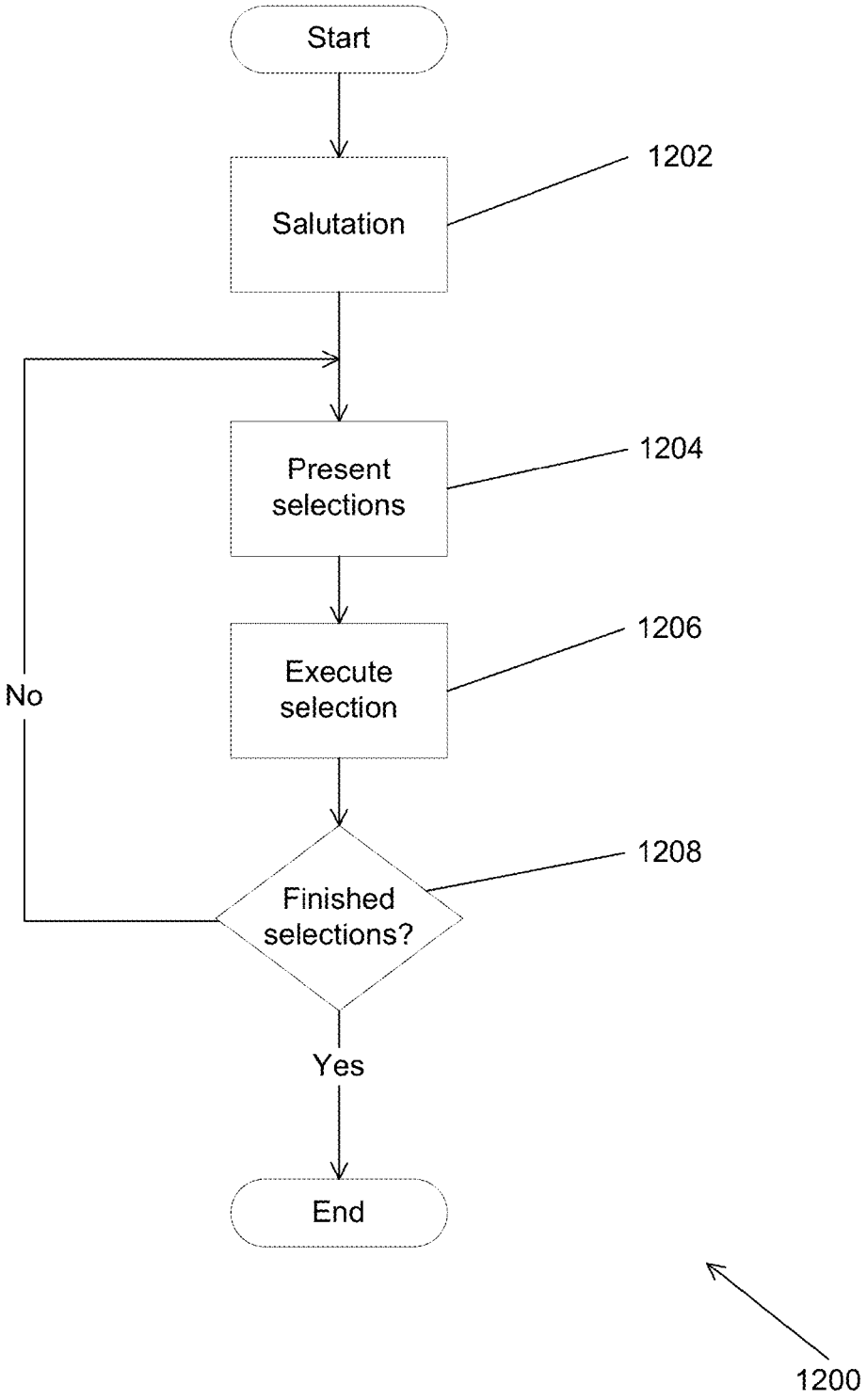
FIGS. 7A and 7B illustrate a process flow diagram for a real world engine module selection and configuration process for use by an operator in accordance with an embodiment.
Figure 7B:
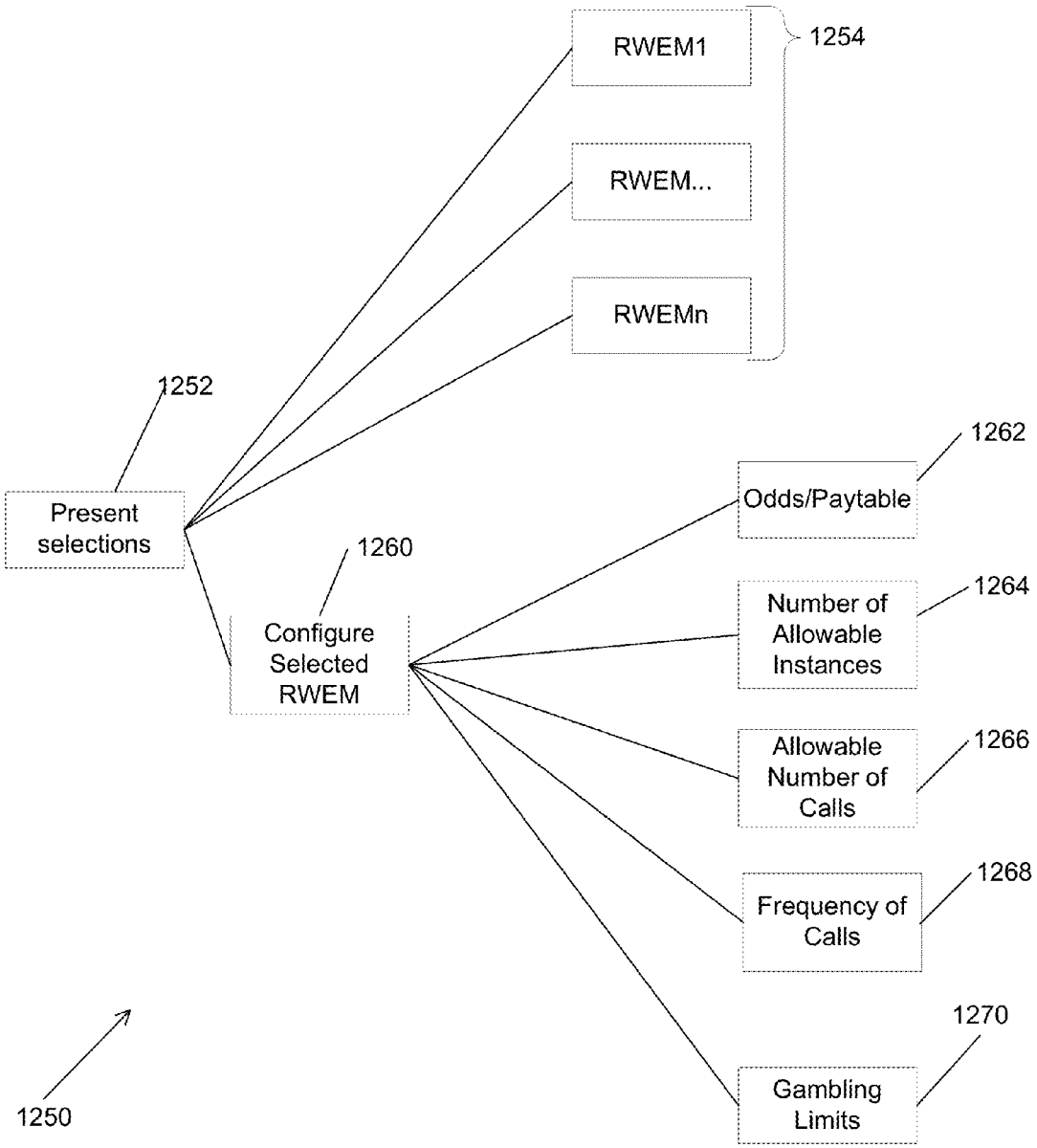

A process for personalizing a real world engine module hybrid game based on operator selections to be associated with a RWEM in a real world engine module hybrid game is illustrated in FIGS. 7A and 7B. The process 1200 includes a salutation (1202) from the real world engine module hybrid game presented via the game's user interface. After the salutation (1202), the real world engine module hybrid game presents (1204) selections among different options via the user interface. After polling (1204) for a selection, the real world engine module hybrid game executes (1206) a process associated with the selection. A decision (1208) is made as to whether selections are finished in personalizing the real world engine module hybrid game. If the selections are not finished, the process 1200 loops back to polling for (additional) selections. If the selections are finished, the process is complete.

A decision tree illustrating various selections associated with a RWEM in a real world engine module hybrid game in accordance with an embodiment of the invention is illustrated in FIG. 7B. The decision tree 1250 illustrates how selections 1252 of information that can be presented in more detail or selections to configure a RWEM can be accessed on a user interface. These selections can include any number of selections, including (but not limited to) a selection 1254 of a RWEM from one or more RWEMs that are provided within the real world engine module hybrid game, a selection 1260 of a process of configuring a selected RWEM, a selection 1262 for a process for modifying the odds or pay tables of a RWEM, a selection 1264 for a process for modifying the number of allowable instances of a selected RWEM within a real world engine module hybrid game, a selection 1266 for a process of modifying the allowable number of times that a selected RWEM may be called or invoked, a selection 1268 for a process for modifying a frequency with which a RWEM may be called or invoked, and a selection 1270 for a process for modifying limits on the amount or frequency of wagers or bets made during a gambling game implemented by a selected RWEM.

Figure 8A:
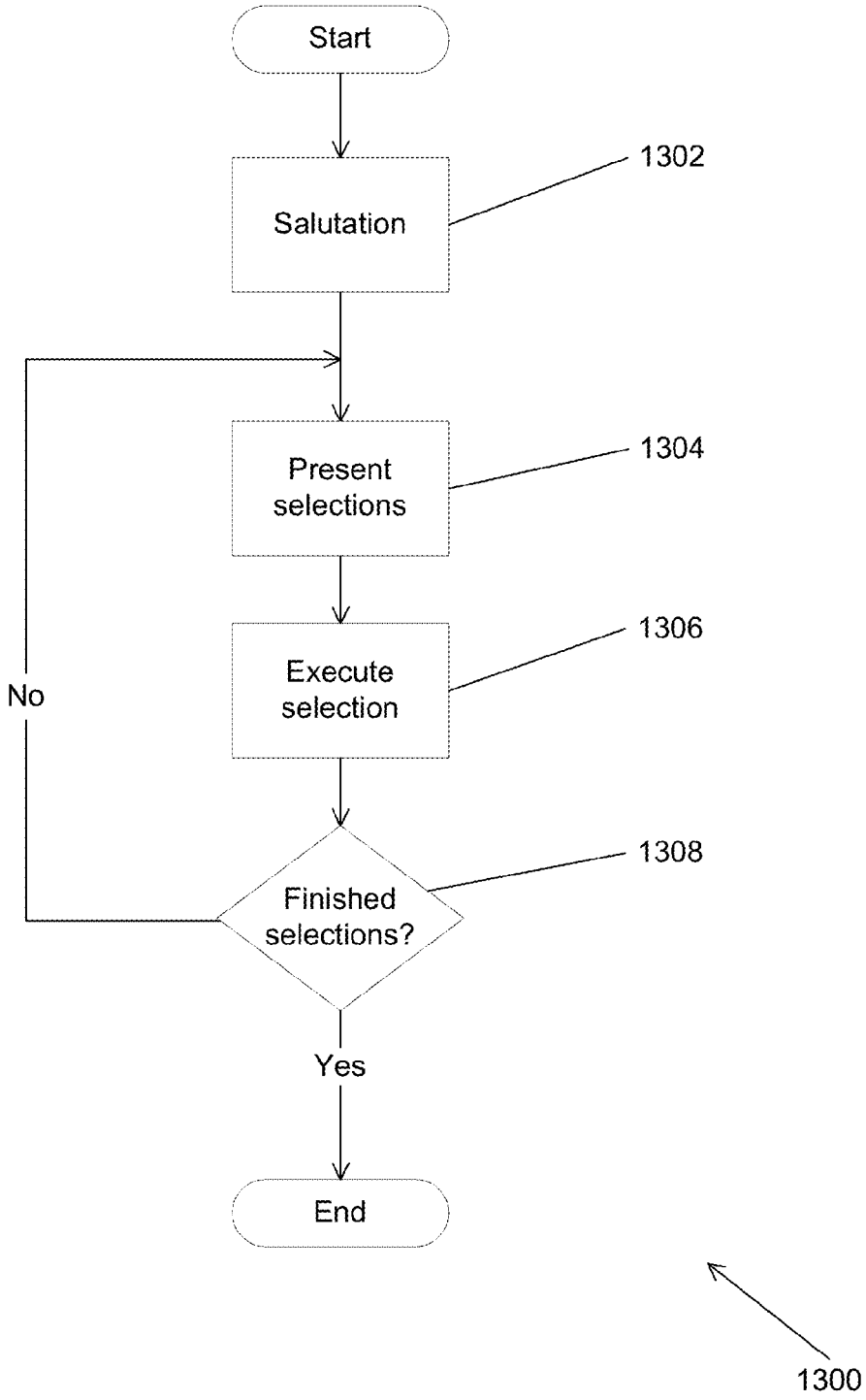
FIGS. 8A and 8B illustrate a process flow diagram for a real world engine module selection and configuration process for use by a player in accordance with an embodiment.
Figure 8B:
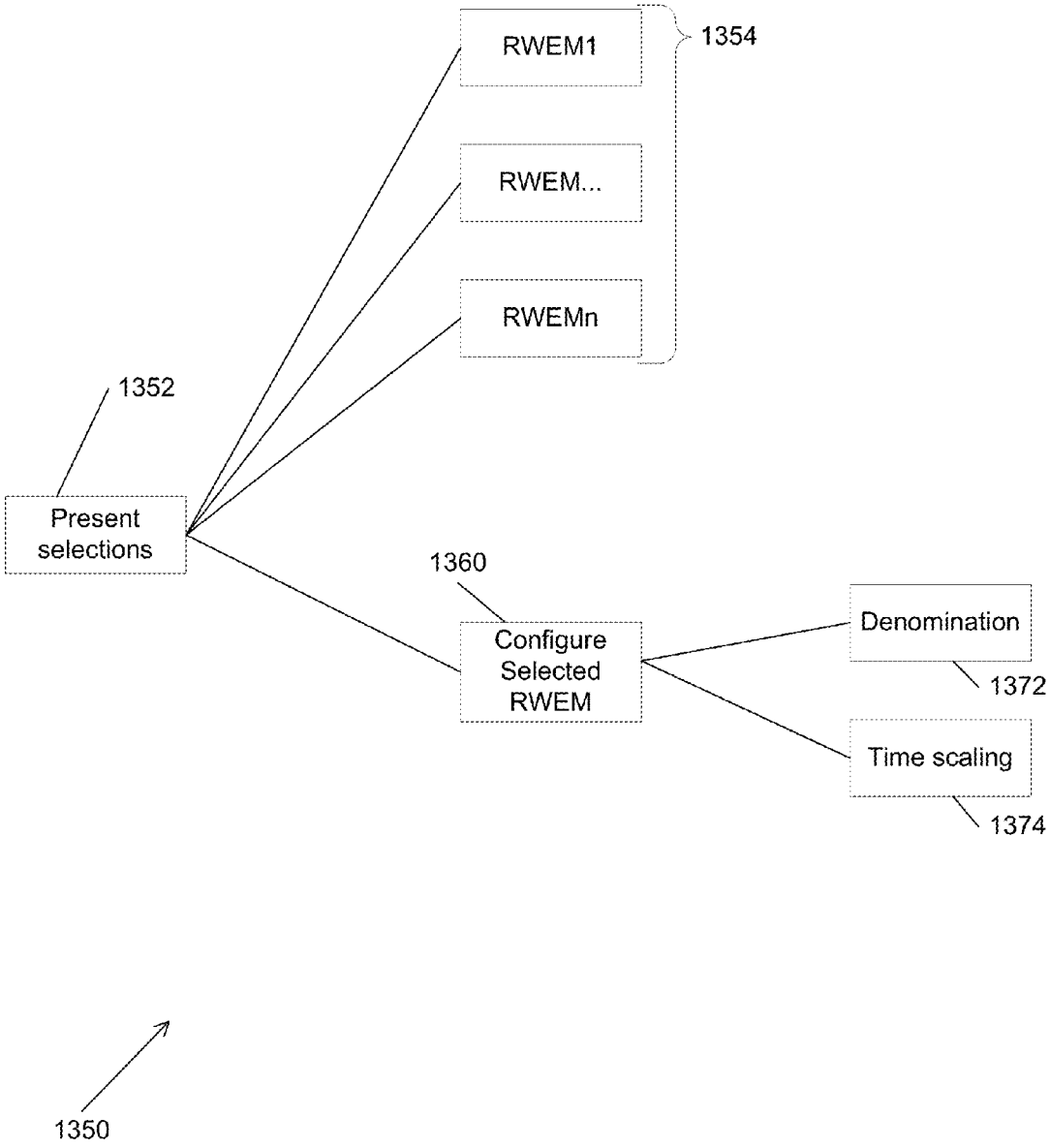

A process for personalizing a real world engine module hybrid game based on player selections to be associated with a RWEM in a real world engine module hybrid game is illustrated in FIGS. 8A and 8B. The process 1300 includes a salutation (1302) from the real world engine module hybrid game presented via the game's user interface. After the salutation (1302), the real world engine module hybrid game presents (1304) selections among different options via the user interface. After polling (1304) for a selection, the real world engine module hybrid game executes (1306) a process for the selection. A decision (1308) is made as to whether selections are finished in personalizing the real world engine module hybrid game. If the selections are not finished, the process 1300 loops back to polling for (additional) selections. If the selections are finished, the process is complete.

A decision tree illustrating various selections associated with a RWEM by a player of a real world engine module hybrid game in accordance with an embodiment of the invention is illustrated in FIG. 8B. The decision tree 1350 illustrates how selections 1352 of information that can be presented in more detail or selections to configure a RWEM can be accessed on a user interface. These selections can include any number of selections, including (but not limited to) a selection 1354 of one or more RWEMs the user wants to use while playing the real world engine module hybrid game and a process of enabling the triggering of the selected RWEM by a player action taken within an entertainment game of the real world engine module hybrid game during gameplay, a selection 1360 for a process of configuring a selected or active RWEM, a selection 1372 for a process of setting a denomination for a selected or active RWEM, and a selection 1374 for a process of setting the time scaling of a RWEM that accepts wagers based on periodic events in a real world engine module hybrid game, Although specific options are discussed above allowing a player to personalize an RWEM of a real world engine module hybrid game, a real world engine module hybrid game can be personalized in any way as appropriate to the requirements of a specific application in accordance with embodiments of the invention. A discussion of processing apparatuses that can implement a real world module hybrid game is below.

Processing Apparatuses

Figure 9:
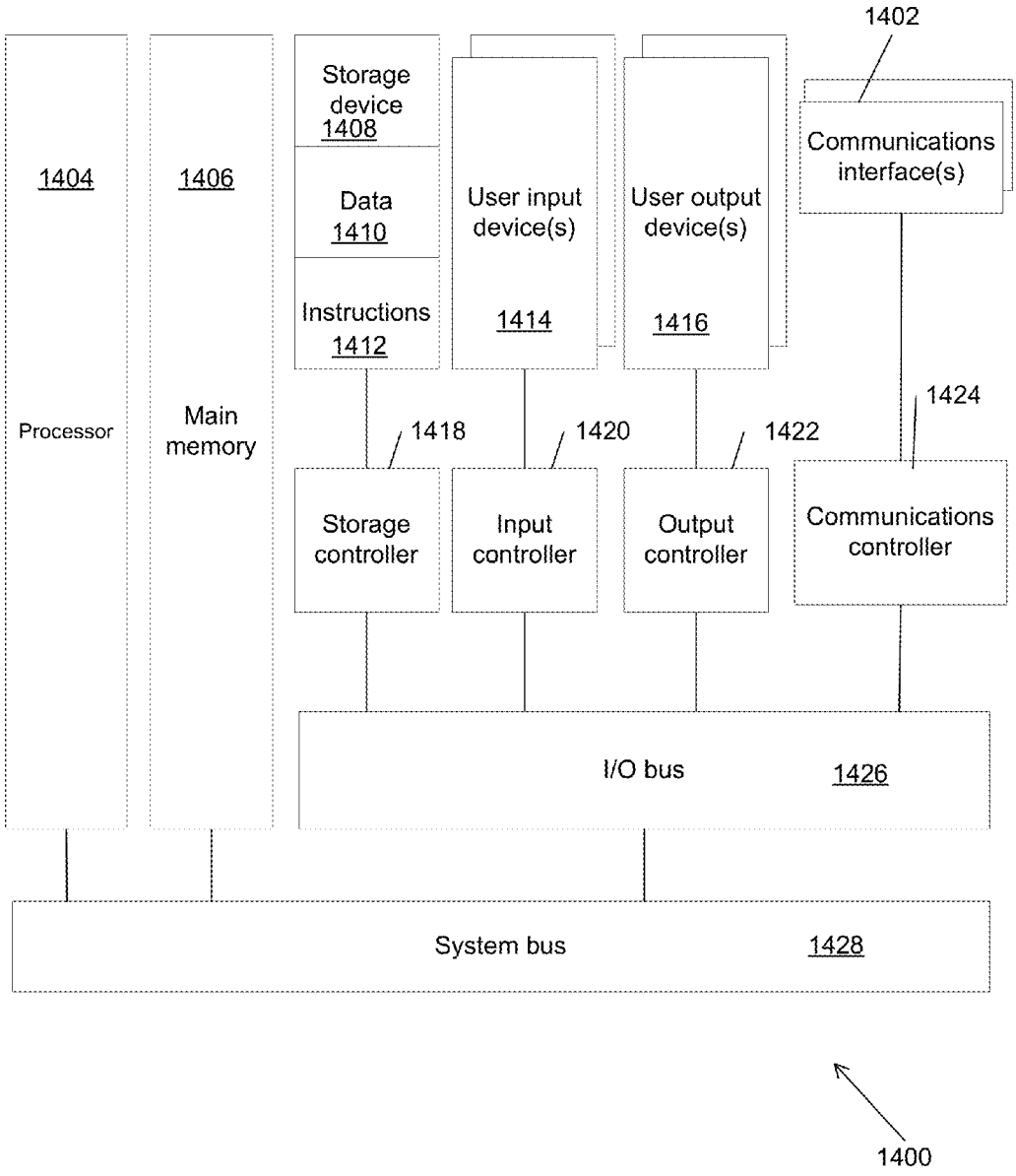
FIG. 9 illustrates a processing apparatus in accordance an embodiment.

Any of a variety of processing apparatuses can host various components of a regulated hybrid gaming system in accordance with embodiments of the invention. In several embodiments, these processing apparatuses can include, but are not limited to, a gaming machine, a general purpose computer, a mobile device, a computing device and/or a controller. A processing apparatus in accordance with various embodiments of the invention is illustrated in FIG. 9. In the processing apparatus 1400, a processor 1404 is coupled to a memory 1406 by a bus 1428. The processor 1404 is also coupled to non-transitory processor-readable storage media, such as a storage device 1408 that stores processor-executable instructions 1412 and data 1410 through the system bus 1428 to an I/O bus 1426 through a storage controller 1418. The processor 1404 is also coupled to one or more interfaces that may be used to connect the processor to other processing apparatuses as well as networks as described herein. The processor 1404 is also coupled via the bus to user input devices 1414, such as tactile devices like keyboards, keypads, foot pads, touch screens, trackballs, etc., as well as non-contact devices such as audio input devices, motion sensors and motion capture devices, etc. that the processing apparatus may use to receive inputs from a user when the user interacts with the processing apparatus. The processor 1404 is connected to these user input devices 1414 through the system bus 1428, to the I/O bus 1426 and through the input controller 1420. The processor 1404 is also coupled via the bus to user output devices 1416 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1428 to the I/O bus 1426 and through the output controller 1422. The processor 1404 can also be connected to a communications interface 1402 from the system bus 1428 to the I/O bus 1426 through a communications controller 1424.

In various embodiments, a processor loads the instructions and the data from the storage device into the memory and executes the instructions and operates on the data to implement the various aspects and features of the components of a gaming environment as described herein. The processor uses the user input devices and the user output devices in accordance with the instructions and the data in order to create and operate user interfaces for players, casino operators, owners, etc. as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as a USB memory device, an optical CD ROM, magnetic media such as tape or disks, etc. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of a gaming environment, an RWEM, a GWE or an ESE as described herein can be implemented on one or more processing apparatuses, whether dedicated, shared or distributed in any combination thereof, or may be implemented on a single processing apparatus. In addition, while certain aspects and features of a gaming system described herein have been attributed to a an RWE, a GWE or an ESE, these aspects and features may be implemented in a hybrid form where any of the features or aspects may be performed by any of an RWE, a GWE or an ESE within a gaming environment without deviating from the spirit of the embodiments disclosed herein.

While the above description contains many specific embodiments of the invention, these should not be construed as limitations on the scope of the invention, but rather as an example of one embodiment thereof. It is therefore to be understood that the invention can be practiced otherwise than as specifically described, without departing from the scope and spirit of the invention. Thus, embodiments of the invention should be considered in all respects as illustrative and not restrictive.

What is claimed is:

1. A method of configuring a gaming system, comprising:

providing an entertainment software engine, the entertainment software engine including an entertainment game, the entertainment game including one or more elements for utilization by a player during skillful play of the entertainment game;

coupling via a network, the entertainment software engine to a game world engine, the game world engine associating the player's utilization of the one or more elements of the entertainment game during skillful play of the entertainment game with a triggering of a commitment of a wager of real world credits to a gambling game of a real world engine module;

providing a plurality of real world engine modules, each real world engine module having a singular gambling game;

receiving, by the game world engine from the entertainment software engine via the network, a selection by the player of a selected real world engine module of the plurality of real world engine modules; and coupling the entertainment software engine, by the game world engine via the network, to the selected real world engine module by enabling triggering of the commitment of the wager of real world credits in the selected real world engine module's gambling game by the player's utilization of the one or more elements of the entertainment game during the player's skillful play of the entertainment game.

2. The method of claim 1, further comprising:

receiving, by the game world engine from the entertainment software engine via the network, a selection by the player of a configuration process for the selected real world engine module; and configuring by the game world engine, the real world engine module based on the selected configuration process.

3. The method of claim 2, wherein the selected configuration process is for configuration of the selected real world engine module's gambling game denomination.

4. The method of claim 1, wherein the game world engine couples to the selected real world engine module via the network.

5. The method of claim 1, wherein the network is a wide area network.

6. The method of claim 5, wherein the wide area network is the Internet.

7. The method of claim 1, wherein the network is for a land based installation.

8. A method of configuring a gaming system, comprising:

providing an entertainment software engine, the entertainment software engine including an entertainment game, the entertainment game including one or more elements for utilization by a player during skillful play of the entertainment game;

coupling via a network, the entertainment software engine to a game world engine, the game world engine associating the player's utilization of the one or more elements of the entertainment game during skillful play of the entertainment game with a triggering of a commitment of a wager of real world credits to a gambling game of a real world engine module;

providing a plurality of real world engine modules, each real world engine module having a singular gambling game;

receiving, by the game world engine from an operator of the gaming system, a selection of a selected real world engine module of the plurality of real world engine modules;

receiving, from the operator, a selection of a configuration process for the selected real world engine module;

configuring the selected real world engine module on the basis of the selected configuration process; and coupling the entertainment software engine, by the game world engine via the network, to the selected real world engine module, the game world engine enabling triggering of the commitment of the wager of real world credits in the selected real world engine module's gambling game by the utilization of the one or more elements of the entertainment game during the player's skillful play of the entertainment game.

9. The method of claim 8, wherein the selected configuration process is for setting a pay table for the selected real world engine module's gambling game.

10. The method of claim 8, wherein the selected configuration process is for setting a gambling limit for the selected real world engine module's gambling game.

11. The method of claim 8, wherein the game world engine couples to the selected real world engine module via the network.

12. The method of claim 8, wherein the network is a wide area network.

13. The method of claim 12, wherein the wide area network is the Internet.

14. The method of claim 8, wherein the network is for a land based installation.

15. A gaming system comprising:

an entertainment software engine;

a game world engine coupled to the entertainment software engine via a network; and a plurality real world engine modules, each real world engine module having a singular gambling game;

wherein the entertainment software engine comprises:

at least one entertainment software engine processor; and an entertainment software engine memory coupled to the at least one entertainment software engine processor, the entertainment software engine memory storing entertainment software engine instructions executable by the at least one entertainment software engine processor, the entertainment software engine instructions comprising an entertainment game, the entertainment game including one or more elements for utilization by a player during skillful play of the entertainment game, and wherein the game world engine comprises:

at least one game world engine processor; and a game world engine memory coupled to the at least one game world engine processor, the game world engine memory storing game world engine instructions executable by the at least one game world engine processor, the game world engine instructions comprising:

associating the utilization by the entertainment software engine of the one or more elements of the entertainment game during skillful play of the entertainment game;

triggering a commitment of a wager of real world credits to a gambling game of a real world engine module of the plurality of real world modules;

receiving, from the entertainment software engine a selection by the player of a selected real world engine module of the plurality of real world engine modules; and coupling the entertainment software engine, by the game world engine via the network, to the selected real world engine module by enabling triggering of the commitment of the wager of real world credits in the selected real world engine module's gambling game by the player's utilization of the one or more elements of the entertainment game during the player's skillful play of the entertainment game.

16. The gaming system of claim 15, the game world engine instructions further comprising:

receiving, from the entertainment software engine, by the game world engine via the network, a player's selection of a configuration process for the selected real world engine module; and configuring the selected real world engine module based on the selected configuration process.

17. The gaming system of claim 16, wherein the selected configuration process is for configuration of the selected real world engine module's gambling game denomination.

18. The gaming system of claim 15, wherein the game world engine couples to the selected real world engine module via the network.

19. The gaming system of claim 15, wherein the network is a wide area network.

20. The gaming system of claim 19, wherein the wide area network is the internet.

21. The gaming system of claim 15, wherein the network is for a land based installation.

22. The gaming system of claim 15, wherein the plurality of real world modules are hosted by the game world engine.

23. A gaming system comprising:

an entertainment software engine;

a game world engine coupled to the entertainment software engine via a network; and a plurality real world engine modules, each real world engine module having a singular gambling game;

wherein the entertainment software engine comprises:

at least one entertainment software engine processor; and an entertainment software engine memory coupled to the at least one entertainment software engine processor, the entertainment software engine memory storing entertainment software engine instructions executable by the at least one entertainment software engine processor, the entertainment software engine instructions comprising an entertainment game, the entertainment game including one or more elements for utilization by a player during skillful play of the entertainment game, and wherein the game world engine comprises:

at least one game world engine processor; and a game world engine memory coupled to the at least one game world engine processor, the game world engine memory storing game world engine instructions executable by the at least one game world engine processor, the game world engine instructions comprising:

associating the player's utilization of the one or more elements of the entertainment game during skillful play of the entertainment game with a triggering of a commitment of a wager of real world credits to a gambling game of a real world engine module;

receiving, from an operator of the hybrid game, a selection of a selected real world engine module of the plurality of real world engine modules;

receiving, from the operator, a selection of a configuration process for the selected real world engine module;

configuring the selected real world engine module on the basis of the selected configuration process; and coupling the entertainment software engine to the selected real world engine module via the network, enabling triggering of the commitment of the wager of real world credits in the selected real world engine module's gambling game by the player's utilization of the one or more elements of the entertainment game during the player's skillful play of the entertainment game.

24. The gaming system of claim 23, wherein the selected configuration process is for setting a pay table for the selected real world engine module's gambling game.

25. The gaming system of claim 23, wherein the selected configuration process is for setting a gambling limit for the selected real world engine module's gambling game.

26. The method of claim 23, wherein the game world engine couples to the selected real world engine via the network.

27. The gaming system of claim 23, wherein the network is a wide area network.

28. The gaming system of claim 27, wherein the wide area network is the Internet.

29. The gaming system of claim 23, wherein the network is a land based installation.

30. The gaming system of claim 23, wherein the plurality of real world modules are hosted by the game world engine.

* * * * *